US005638621A

United States Patent [19]

Keech et al.

[11] Patent Number: 5,638,621

[45] Date of Patent: Jun. 17, 1997

[54] SPOOL AND WEDGE ASSEMBLY AND METHOD OF USE THEREOF

[76] Inventors: Garth Alexander Keech, 93 Tennyson Road, Gladesville, New South Wales, 2116, Australia; William Gibbs, 46 Milford Road, Miranda, New South Wales, 2228, Australia

[21] Appl. No.: 603,849

[22] Filed: Dec. 5, 1995

[51] Int. Cl.[6] ..... E02F 9/28

[52] U.S. Cl. ..... 37/446; 37/458; 37/456

[58] Field of Search ..... 37/446, 452, 453, 37/454, 455, 456, 457, 458, 459

[56] References Cited

U.S. PATENT DOCUMENTS

| | | | |
|---|---|---|---|
| 475,746 | 5/1892 | Assorati | 37/458 X |
| 2,385,395 | 9/1945 | Baer | 37/458 X |
| 2,939,227 | 6/1960 | Berger | 37/456 |
| 2,992,498 | 7/1961 | Mork | 37/458 |
| 4,433,496 | 2/1984 | Jones et al. | 37/456 |
| 4,962,432 | 10/1990 | Ohtsuka et al. . | |
| 5,131,053 | 7/1992 | Bernzott et al. . | |
| 5,276,315 | 1/1994 | Surka . | |
| 5,296,690 | 3/1994 | Chandler et al. . | |
| 5,410,826 | 5/1995 | Immel et al. | 37/457 |
| 5,468,947 | 11/1995 | Danielson et al. . | |

*Primary Examiner*—Terry Lee Melius
*Assistant Examiner*—Robert Pezzuto
*Attorney, Agent, or Firm*—Darby & Darby

[57] ABSTRACT

A spool and wedge assembly for securing replaceable cutting teeth or cutting elements to the nose portions of earth moving buckets. The spool and wedge assembly comprises first and second parallel longitudinally extended spool elements, which are transversely displaced apart to engage the aligned side walls of the securing element receiving apertures, and, first and second wedge shaped elements. The wedge and spool elements are interconnected by a longitudinally disposed screw threaded bolt mechanism which is tightened to draw the first and second wedge elements together while forcing the first and second spool elements apart, such that the cutting teeth are locked in position.

11 Claims, 5 Drawing Sheets

SPOOL AND WEDGE ASSEMBLY AND METHOD OF USE THEREOF

Figure 1:
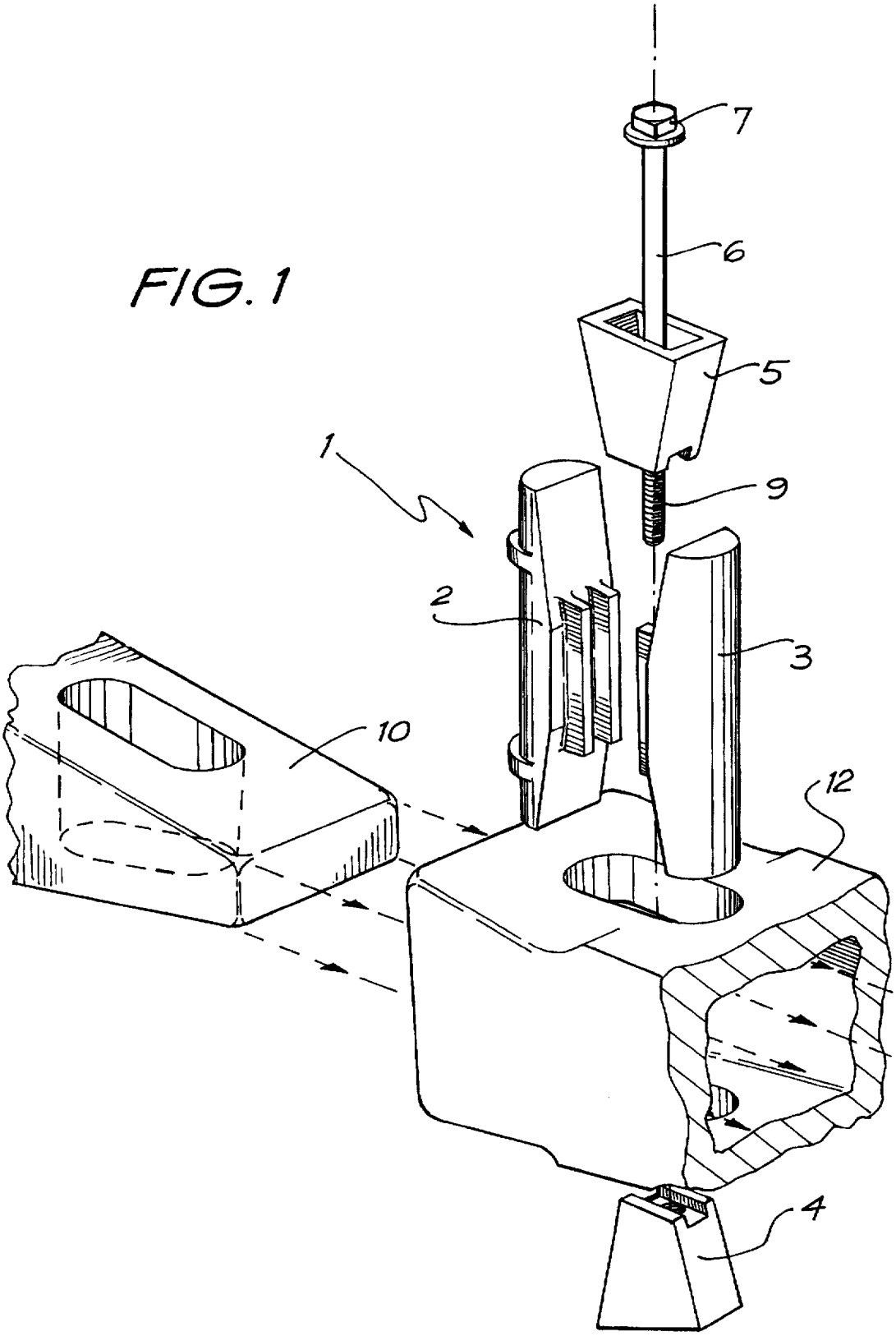

This is a continuation of international application Ser. No. PCT/AU94/00035, filed Jan. 28, 1994.

The present invention relates to a spool and wedge assembly for use with earthworks buckets such as is used on drag lines, scrapers, levellers and excavating equipment. The invention also relates to a method of attachment to said earthworks buckets of detachable implements by use of a spool and wedge assembly.

More particularly the invention relates to a spool and wedge assembly and method of use thereof for connecting implements such as teeth and/or an adaptor having a wear disadvantage to said buckets.

In the heavy earthworks industry, buckets attached to heavy earthmoving equipment are fitted with leading edge implements for cutting or moving overburden. These implements commonly referred to as teeth must by necessity be replaceable due to heavy wear and tear.

Teeth are generally fixed to a bucket in one of two ways. In the case of smaller buckets the teeth are detachably fixed directly to what is known as a bucket nose formed integral with the bucket. In the case of the larger buckets the teeth are fitted via an adaptor which attaches to a specifically configured integral formation in the bucket leading edge. The teeth and adaptors are subjected to heavy wear and must be regularly replaced with the life of the teeth and adaptors being generally dictated by the nature of over burden that the bucket is required to move. In the case of drag lines the wear is significant. According to the prior art, the teeth are generally wedge shaped and attach to the leading edge of the adaptor by pin encapsulation, the pin comprising the spool and wedge assembly.

The adaptor mates via its trailing end to the bucket leading edge. More particularly the adaptor attaches to the said formation on the leading edge whereby the formation enters a recess in the adaptor. At present, fixing of the adaptor to the formation is effected by a known spool and wedge assembly which comprises a generally elongated truncated cylindrical spool and a wedge which mutually cooperate to secure the adaptor to the bucket. Buckets usually have a multiplicity of such spool and wedge assemblies spaced apart along the leading edge of the bucket generally commensurate with the number of teeth on the bucket. In the case of large buckets there could be half a dozen or more spool and wedge assemblies which require constant removal to facilitate replacement of teeth and adaptors.

Not only do the adaptors and teeth require replacement after excessive wear, they also require constant monitoring during use to ensure that they do not become sloppy and loose thereby inhibiting the efficiency of the operation of the teeth.

Presently, according to one method, in order to fit the wedge and spool assembly, the wedge and spool are placed into a recess formed in both the adaptor and bucket leading edge formation and which is axially aligned when the adaptor is properly fitted to the bucket. The wedge element is then driven home axially by a sledge hammer induce a wedging force in the spool and wedge assembly to thereby secure the adaptor to the bucket. A tight fit is ensured by jamming the wedge against the spool. At present, the spool and wedge assembly extends axially downwardly beyond the periphery of the underside of the adaptor in the case of the large the buckets and beyond the teeth in the case of the smaller buckets. The extension engages the ground during use of the buckets and causes the adaptor and/or teeth to become loose as the wedge and spool work loose. This occurs particularly in circumstances where the bucket is used to excavate hard and rocky ground. Personnel are employed to regularly check the integrity of the connection of the adaptor and teeth. Where the fit works loose due to movement of the wedge and spool assembly it must be constantly hammered back in to tighten the connection. This is a labour intensive and physically demanding activity. Likewise, when a spool and wedge assembly is to be released to free the adaptor from the bucket the assembly must be violently hammered to remove it and generally from underneath the bucket. For this purpose the bucket must be lifted up to enable a labourer to gain access to the distal end of the wedge and spool assembly. Due to the intensely physical nature of this work, many men are required to fit and remove the adaptors and teeth and to check and ensure tightness of the fit.

According to the prior art methodology trades people such as fitters are employed to fit the spool and wedge assemblies to the buckets. The spool and wedge assembly is inserted into a recess in the implement to be fitted to the bucket. The wedge part of the assembly is hammered with a sledge hammer to drive the wedge home. Once a tight fit is achieved the bucket is used a small number of times and then rechecked. If loosening occurs during that brief use, the fitter drives the wedge in even further until it is tight enough to allow continued operation of the bucket. At that time any part of the spool and wedge assembly which extends beyond the extremity of the implements fitted to the bucket are removed by means of an oxy acetylene cutter.

The problem in removing the head piece and tail piece of the spool and wedge assembly is that if it again becomes loose it is difficult for the fitter to hammer the top of the wedge as it is flush with the surface of the implement fitted to the bucket.

Also, when an implement such as a tooth is finally worn out it can sometimes be so difficult to remove the spool and wedge assembly that it is necessary to cut through the old tooth and/or adaptor in order to remove the assembly. This clearly adds to the cost of fitting and maintaining the known spool and wedge assemblies.

It is an object of the present invention to ameliorate the aforesaid disadvantages. It is a further object of the present invention to provide spool and wedge assembly which provides a convenient method for fitting adjusting and/or removing from a bucket implements fixed by the spool and wedge assembly.

In one broad form of the apparatus aspect, the present invention comprises, a spool and wedge assembly for use in connecting a replaceable element to an earthmoving bucket, said spool and wedge assembly comprising;

first and second spool members, first and second wedge members, a bolt releasably attached to said first and second wedge members, wherein the assembly is adapted to fit within aligned recesses in the element and in the bucket, such that in use, turning of said bolt in one direction urges the first and second spools away from each other as the wedges advance towards each other such that they move apart laterally bear against the walls of said recesses, said assembly being releasable from said recesses on turning the bolt in the opposite direction.

In the broadest form of the apparatus aspect the present invention comprises, a spool and wedge assembly for use in securing an implement to the nose of an earth moving bucket, said spool and wedge assembly comprising:

first and second spool elements, first and second wedges sandwiched in a space between the spool elements and able to travel towards each other within a space defined by the spool elements, a connecting element which contacts said first and second wedges wherein when said connecting element is moved in a first direction the said wedges are drawn towards each other thereby forcing said spools apart and against the wall of a recess in which said spool and wedge assembly is placed thereby securing said implement to said bucket and when the connecting element is turned in a second direction the wedges move away from each other thereby loosening the assembly.

Preferably, the spool elements each comprise an elongate bar having inclined surfaces which in case engage with corresponding inclined surfaces on the wedges. The spool and wedge assembly close fits into the recess in which it is located so that the spools are very close to the wall of the recess. In this condition slight movement of the wedges by turning the connecting element commences the wedging of the assembly.

A threaded bolt with a hexagonal nut may be used as the connecting element.

The present invention also comprises a method of fixation of an adaptor or a tooth to the nose of an earth moving bucket.

In one broad form of the method aspect the present invention comprises the steps of:

a) taking a spool and wedge assembly comprising first and second spool elements, first and second wedges which locate between the first and second spool elements and which are held therebetween by means of a connecting element;

b) placing the spool and wedge assembly within a recess in an implement in mating engagement with the bucket nose of an earth moving bucket;

c) rotating said connecting element in one direction to urge the said first and second wedges towards each other by camming engagement between said wedges and said spool elements thereby facilitating lateral displacement of said spool elements in opposing directions to thereby cause tight frictional interfitting between the walls of said recess and the spool and wedge assembly to secure said implement to said bucket.

The method comprises the additional step of rotating the connecting element in the opposite direction to release the assembly from the recess.

The present invention will now be described in more detail according to a preferred but non limiting embodiment and with reference to the accompanying illustrations wherein;

FIG. 1: shows an exploded perspective view of a spool and wedge assembly fitted to an adaptor according to a preferred embodiment of the invention.

Figure 2:
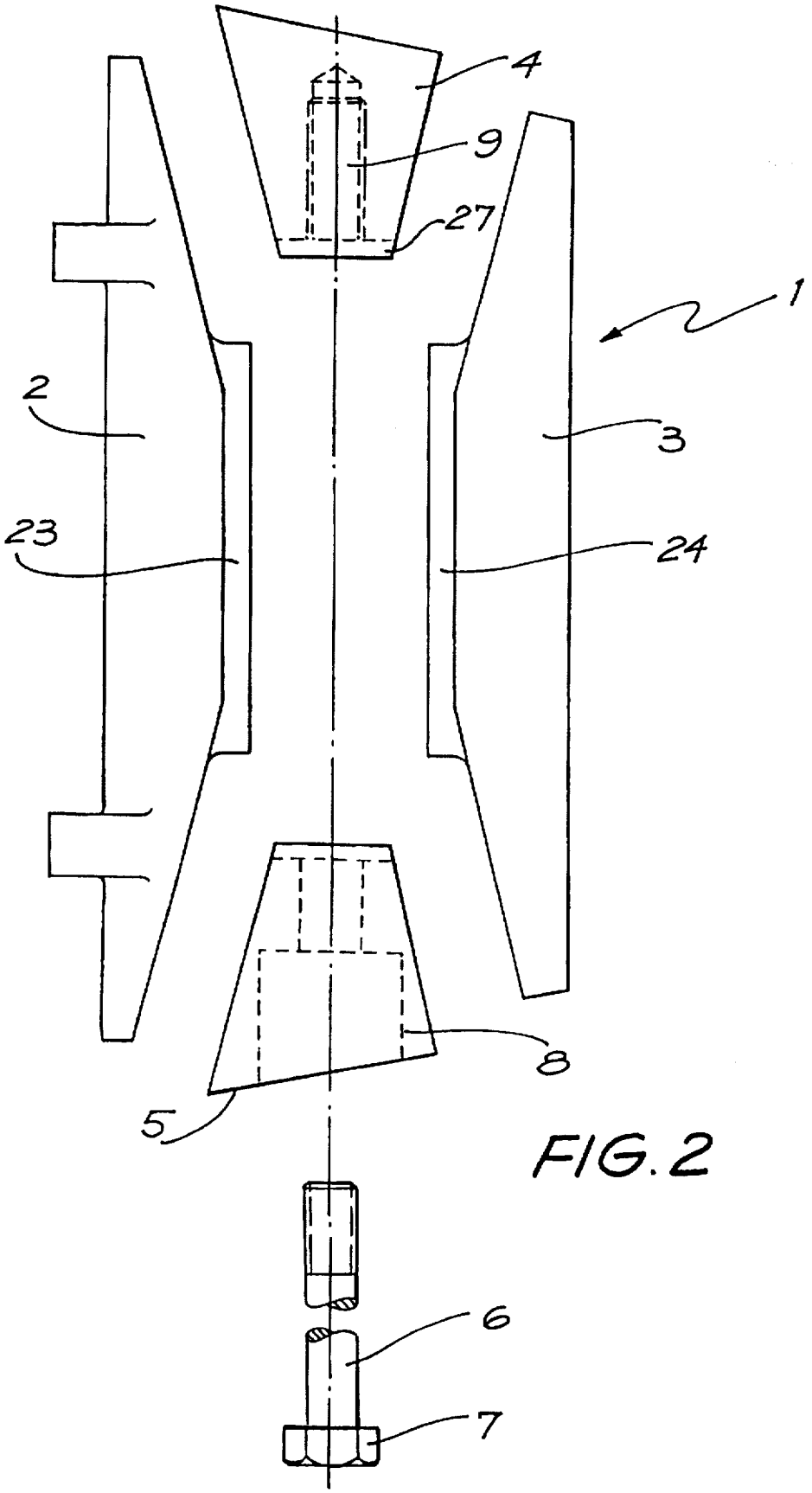

FIG. 2: shows a cross sectional exploded view of the spool and wedge assembly of FIG. 1.

Figure 3:
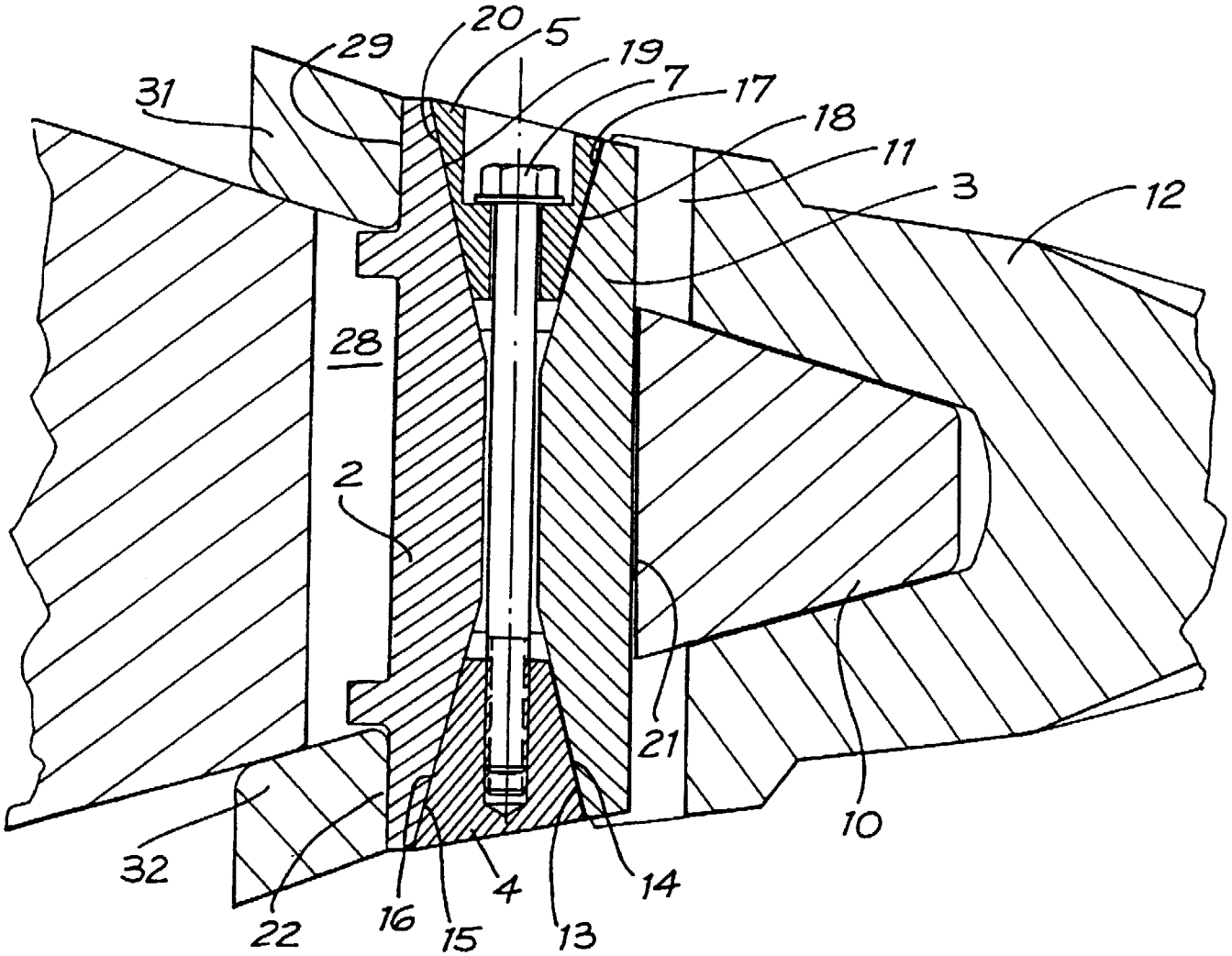

FIG. 3: shows a cross sectional elevational view of the spool and wedge assembly fitted to a bucket nose according to a preferred embodiment of the invention.

Figure 4A:
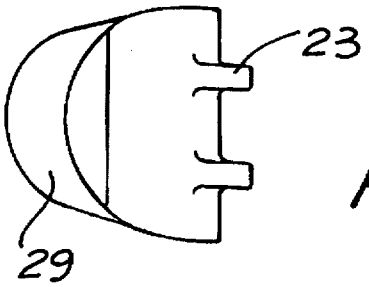

FIGS. 4*a, b, c:* show a plan and two elevational views of one spool of the assembly according to a preferred embodiment.

Figure 5A:
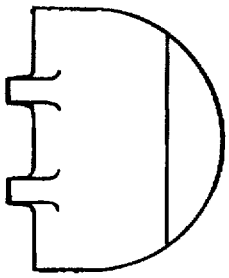
Figure 5B:
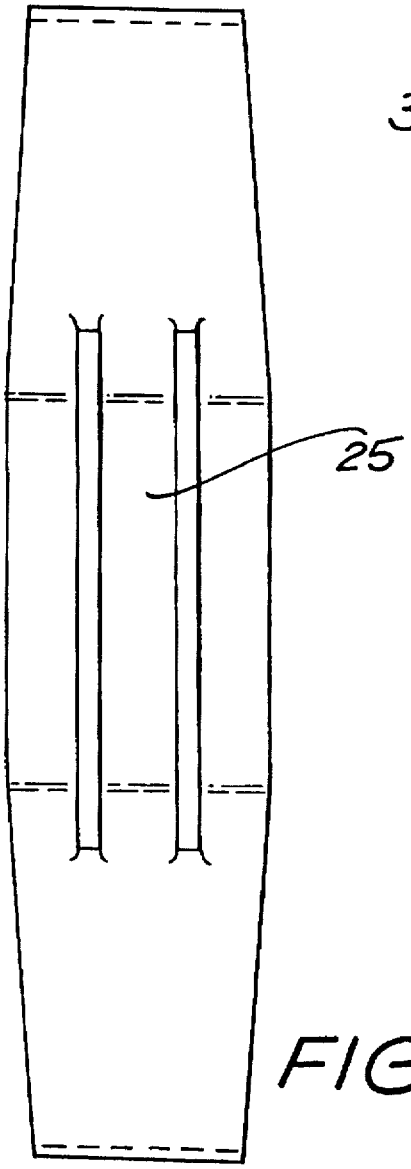
Figure 5C:
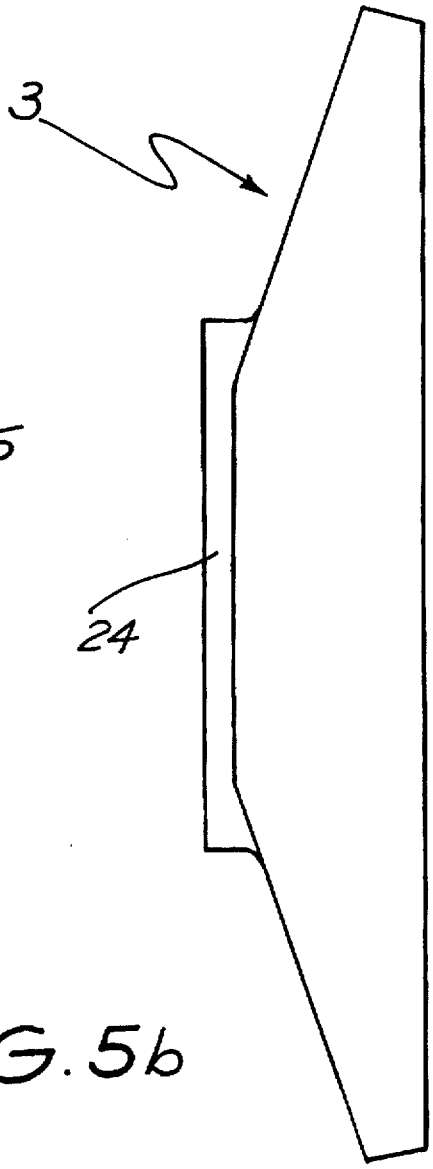

FIGS. 5*a, b, c:* show a plan and two elevational views of the second spool of the assembly according to a preferred embodiment Referring to FIG. 1 there is shown an exploded perspective view of a spool and wedge assembly 1 according to a preferred embodiment of the invention. The assembly comprises first and second opposing spool members 2 and 3 and includes first and second wedge members 4 and 5 linked by means of a connecting element which may be provided by bolt 6. Bolt 6 is adapted with hexagonal head 7 which preferably fits within recess 8 formed in wedge 5. Bolt 6 may include a threaded portion 9 which threadably engages first wedge member 4. This is best shown in the view in FIG. 2. Alternatively, the bolt 6 is simply keyed into the wedge 4 such that when bolt head 7 is turned wedge 4 is drawn towards wedge 5. The wedge assembly of FIG. 1 is shown exploded from an adaptor 12. Adaptor 12 is exploded from bucket nose 10. In the case of the small buckets a tooth is fitted directly onto bucket nose 10.

FIG. 2 shows a cross sectional exploded view of the assembly of FIG. 1. Each of the spools 2 and 3 comprise a set of spaced apart aligning ribs 23 and 24 respectively which define passages 25 and 26 (see FIGS. 4*a* and 5*a*.

Spools 2 and 3 oppose each other such that each rib of the sets of ribs 23 and 24 are in alignment thereby creating passages 25 and 26 within which bolt 6 locates.

Bolt head 7 locates within recess 8 in wedge 5. Threaded portion 9 of bolt 6 locates in recess 27 of wedge 4.

FIG. 3 shows a cross sectional assembled view of the assembly 1 fitted within a passage 28 in bucket nose 10. Passage 28 aligns with passage 11 in adaptor 12. Passages 28 and 11 are substantially in alignment when the adaptor is properly fitted to the bucket nose 10. When an adaptor is to be fitted to the bucket nose 10, the passages are first aligned so as to enable feeding therein of assembly 1 in a loosely assembled form. When the assembly 1 is in position, the user rotates head 7 of bolt 6 in a first direction which urges wedges 4 and 5 towards each other. When the assembly 1 is in position the wedges 4 and 5 abut spools 2 and 3. Contact between wedge 4 and spools 2 and 3 takes place via abutment of surface 13 of the wedge against surface 14 of spool 3 and abutment of surface 15 of wedge 4 against surface 16 of the spool. Similarly, contact between wedge 5 and spools 2 and 3 takes place via abutment of surface 17 of the wedge against surface 18 and surface 19 of wedge 5 against surface 20 of spool. The camming action generated between the aforesaid contacting surfaces induces a wedging effect and urges spools 2 and 3 in opposing directions and against the wall 21 in the case of bucket nose 10 and walls 22 and 29 in the case of adaptor 12. When the wedge assembly is to be removed the head 7 of bolt 6 is turned in the opposite direction thereby loosening the wedges enabling simple and convenient removal.

Figure 4B:
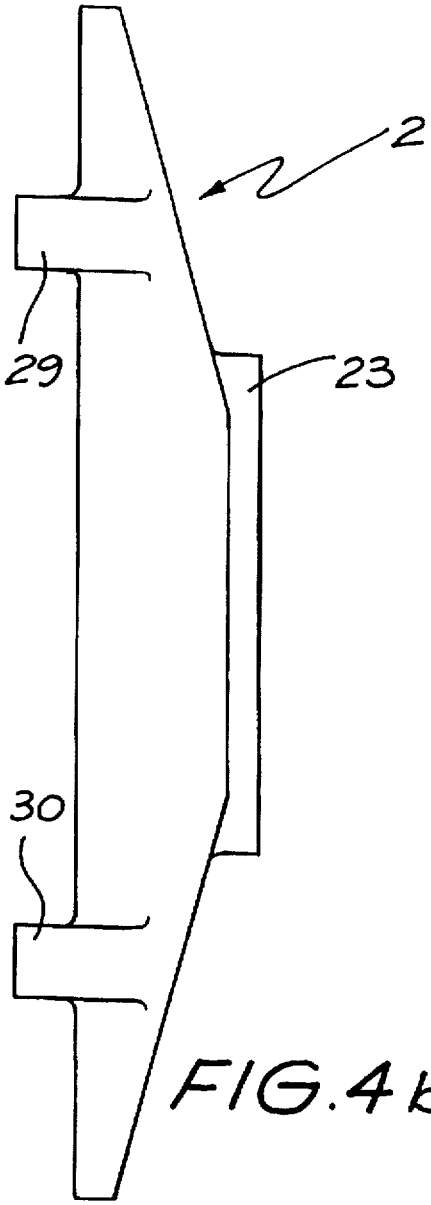
Figure 4C:
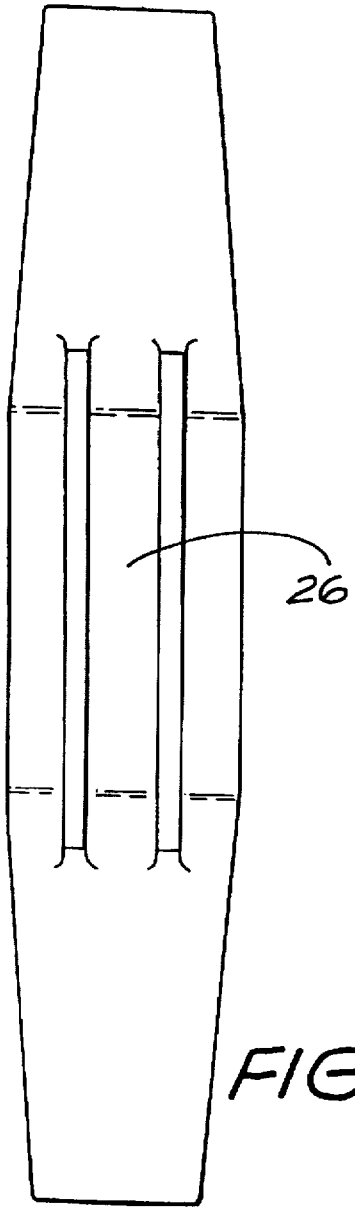

Referring to FIG. 4 there is shown three views of a typical spool. The three FIGS. 4*a*, 4*b* and 4*c* show a side elevation, front elevation and top plan view respectively. The spool shown is an enlarged version of spool 2 shown in FIGS. 1, 2 and 3.

The essential difference between spools 2 and 3 is that spool 2 has lateral ribs 29 and 30. These locate the spool and wedge assembly within the passage 28 in bucket nose 10 (see FIG. 3). Ribs 29 and 30 bear on shoulders 31 and 32 of adaptor 12 to prevent slippage of the assembly in the event that bolt 6 loosens during use resulting in sloppy fitting of the assembly.

FIG. 5*a, b* and *c* shows views of spool 3 similar to those shown in FIG. 4. Absent from spool 3 are the lateral ribs 29 and 30 of spool 2.

The present invention has the advantage of reduced weight and ease of insertion and release from its work situs.

The physical effort required to remove the spool and wedge assembly is dramatically reduced and no sledge hammering is required. A large mechanical advantage is obtained in use of the bolt assembly to induce the friction forces in the recess rather than relying on the strength of a sledge hammer blow to achieve the same friction effect.

It will be recognised by persons skilled in the art that numerous variations and modifications may be made to the invention as broadly described herein such as but not limited to altering the shape and configuration of the spools and wedges and altering the camming surfaces without departing from the overall spirit and scope of the invention.

We claim:

1. A spool and wedge assembly for use in securing two components, each component having a recess at least partly therethrough, said recesses adapted to be aligned with respect to each other, said spool and wedge assembly comprising:

first and second spool elements;

first and second wedges sandwiched in a space between the spool elements and able to travel towards each other within the space defined by the spool elements; and a connecting element which contacts said first and second wedges;

wherein, when said assembly is placed in said aligned recesses, and when said connecting element is moved in a first direction said wedges are drawn towards each other thereby forcing said spool element apart and against the walls of said recesses in which said spool and wedge assembly is placed thereby securing said two components, and, when the connecting element is turned in a second direction the wedges move away from each other thereby loosening the assembly.

2. A spool and wedge assembly according to claim 1 wherein the connecting element comprises a bolt including a head and a threaded portion which enables the movement of one or both of the wedges therealong upon rotation of the bolt.

3. A spool and wedge assembly according to claim 2 wherein each spool comprises an elongate bar and wherein an inside face of each spool element includes inclined surfaces which engage corresponding inclined surfaces on each wedge thereby creating a wedging action upon turning of the bolt by interaction of the wedges and spool.

4. A spool and wedge assembly according to claim 3 wherein at least one of the spool elements has locating ribs on their rear face to facilitate correct positioning of the assembly in the recess.

5. A spool and wedge assembly according to claim 4 wherein each of the spool elements include longitudinal ribs on their inside face.

6. A spool and wedge assembly according to claim 5 wherein said first wedge engages the head of the bolt and the second wedge engages a distal end of the bolt.

7. A spool and wedge assembly according to claim 6 wherein the head of the bolt locates in a bolt head locating recess formed in the first wedge.

8. A spool and wedge assembly according to claim 7 wherein the distal end of the bolt locates within the said second wedges.

9. A spool and wedge assembly according to claim 8 wherein the components comprise an implement to be connected to the nose of an earthmoving bucket.

10. A method of connecting two components, comprising the steps of;

a) taking a spool and wedge assembly comprising first and second spool element, first and second wedges which locate between the first and second spool elements and which are held therebetween by means of a connecting element;

b) placing the spool and wedge assembly within aligned recesses provided at least partly through each of said two components; and c) rotating said connecting element in one direction to urge the said first and second wedges towards each other by cramming engagement between said wedges and said spool elements thereby facilitating lateral displacement of said spool elements in opposing directions to thereby cause tight frictional interfitting between the walls of said aligned recess and the spool and wedge assembly to secure said components.

11. A method as claimed in claim 10, wherein each spool comprises an elongated member having two inclined surfaces, an intermediate flat surface therebetween having disposed therealong at least two longitudinal ribs each of the inclined surfaces engaging a corresponding wedge.

* * * * *

UNITED STATES PATENT AND TRADEMARK OFFICE

CERTIFICATE OF CORRECTION

PATENT NO. : 5,638,621

DATED : June 17, 1997

INVENTOR(S) : Garth Alexander KEECH et al.

It is certified that error appears in the above-indentified patent and that said Letters Patent is hereby corrected as shown below:

On the title page, please insert the following:

--Related U.S. Application Data

[63] Continuation of PCT/AU94/00035, Jan. 28, 1994.--;

--[30] Foreign Application Priority Data

Jun. 29, 1993 [AU] Australia . . . . . PL 9681--.

Signed and Sealed this

Twenty-third Day of September, 1997

*Attest:*

Bruce Lehman

BRUCE LEHMAN

*Attesting Officer*

*Commissioner of Patents and Trademarks*